US008413411B2

(12) United States Patent
Gottlieb

(10) Patent No.: US 8,413,411 B2
(45) Date of Patent: Apr. 9, 2013

(54) HORSE MOUNTING STIRRUP

(76) Inventor: Robert Gottlieb, Houston, TX (US)

( * ) Notice: Subject to any disclaimer, the term of this patent is extended or adjusted under 35 U.S.C. 154(b) by 239 days.

(21) Appl. No.: 12/500,326

(22) Filed: Jul. 9, 2009

(65) Prior Publication Data

US 2009/0266039 A1 Oct. 29, 2009

Related U.S. Application Data

(63) Continuation-in-part of application No. 12/378,125, filed on Feb. 11, 2009, now abandoned, which is a continuation-in-part of application No. 11/796,060, filed on Apr. 26, 2007, now Pat. No. 7,574,849.

(51) Int. Cl.
*B68C 3/00* (2006.01)

(52) U.S. Cl.
USPC ..... 54/47

(58) Field of Classification Search ..... 54/47–49
See application file for complete search history.

(56) References Cited

U.S. PATENT DOCUMENTS

| | | | | |
|---|---|---|---|---|
| 16,032 | A | 11/1856 | Trussell | |
| 700,053 | A | 10/1867 | Weddington | |
| 261,733 | A | 7/1882 | Larcom | |
| 717,850 | A | 1/1903 | Hey et al. | |
| 841,793 | A | 1/1907 | Levy | |
| 1,062,327 | A | 5/1913 | Erbe | |
| 4,761,938 | A | 8/1988 | Townsend | |
| 5,809,754 | A | 9/1998 | Schulte | |
| 6,026,633 | A * | 2/2000 | Burke, Jr. | 54/47 |
| 6,173,558 | B1 | 1/2001 | Burke, Jr. | |
| 6,282,872 | B1 | 9/2001 | Schulte | |
| 7,380,390 | B1 | 6/2008 | Brassfield | |

FOREIGN PATENT DOCUMENTS

DE 3734795 A1 * 5/1989

* cited by examiner

*Primary Examiner* — Son T Nguyen
(74) *Attorney, Agent, or Firm* — Polsinelli Shughart PC; Malcolm A. Litman; Marcia J. Rodgers

(57) ABSTRACT

A horse stirrup which also functions as a mounting aid by providing, in the same assembly, a foot supporting platform for riding, as well as a convenient, lower level platform for mounting. The mounting platform, and related structure, also function, in cooperation with the riding platform, to reduce the exposure of the rider to stirrup foot lock in case of a fall.

6 Claims, 5 Drawing Sheets

HORSE MOUNTING STIRRUP

CROSS-REFERENCE TO RELATED APPLICATIONS

This application is a continuation-in-part of co-pending application Ser. No. 11/796,060 filed Apr. 26, 2007 entitled "Horse Mounting Aid Assembly", now U.S. Pat. No. 7,575,849, and Ser. No. 12/378,125 filed Feb. 11, 2009 entitled "A Stirrup Assembly" which is a continuation-in-part of said application Ser. No. 11/796,060. Full disclosures of said applications are incorporated herein by reference, the priority of which is hereby claimed.

BACKGROUND

The subject of this application relates to the field of equestrian equipment, and more particularly to a stirrup arrangement which permits the horseman to more safely and easily mount, ride and dismount a horse, or other rideable animal.

Traditionally, stirrups form parts of conventional horse mounting equipment and may be positioned on one or both sides of the saddle. Stirrups are designed not only to assist the rider in mounting, but also in maintaining balance during riding, and when dismounting.

For safety while riding, the bottom, foot resting, portion of the stirrup is generally located at a level where the rider's feet are comfortably engaged when the rider is in the saddle. Depending upon the height of the horse and the leg length of the rider, this may result in the stirrup being too high for the rider to easily engage for mounting the horse. Riders often attempt to overcome this difficulty by searching for something to stand on, or having another person physically assist them. Appropriate items, or persons, are often not available.

Another possibility is adjusting the stirrup to a lower than functional level for mounting, however, this presents the additional problem of readjusting the stirrup when the rider is sitting in the saddle. Even a highly experienced rider is dangerously exposed to an accident while trying to perform this maneuver. When the rider, in the saddle, attempts to reach down for drawing up the stirrup, the required leaning to one side can lead to a fall. Using traditional stirrups, the only safe way to adjust the height is to have another person, one who is dismounted, adjust them for the rider.

In the alternative, a rider may attempt to climb upon an object such as a bucket or ladder to reach the stirrup, but this also can lead to injury caused by the instability of the object or the animal moving at a critical time.

OBJECTS OF THE IMPROVEMENT

One object of the improved stirrup is to greatly increase the safety and convenience of mounting a horse or other rideable animal. Another object is the elimination of mounting drawbacks associated with traditional stirrups and substituting safe, reliable alternatives, without giving rise to excessive costs.

It is yet another object to define herein a fully integrated stirrup assembly which assists a person in mounting a horse from the ground, helps to keep the person safe during such mounting, and provides a simple, reliable transformation of the mounting procedure, and subsequent ride, into a more enjoyable activity.

SUMMARY OF THE IMPROVEMENT

The present improvement in stirrups creates a fully integrated arrangement which is safer, easier to use and more reliable for mounting and riding, as well as being suitable for either English or western type saddles. The improved stirrup allows the rider's foot to be safely positioned in the device during mounting and riding while prohibiting the rider's foot from becoming dangerously stuck or trapped therein.

These advantages are achieved through the provision of a mounting aid assembly which comprises, in one form, a pivotally mounted bottom portion, or step, to which a hollow, open ended, receiver or volume is attached. The receiver, in this example, comprises a cage formed from spaced-apart thin bars or wires, but may be constructed from a variety of other materials. The step presents a generally vertical, out-of-the-way, mounting support surface when pivoted to latched, riding position. However, in response to a small angular rotation in the opposite direction, for example, about a quarter circle, it engages a positioning stop fixed to the stirrup iron. Here the mounting support surface presents a generally horizontal, foot supporting attitude at a location substantially lower than the stirrup support surface used for riding. In this location the mounting support surface serves as a more convenient and safe target for the rider's foot insertion and subsequent swinging upwardly into the saddle. Once in the saddle, this example only needs a simple forward kick to pivot the step into the prior upper, latched position, where the foot is safely and comfortably received for riding without exposure to trapping in case of a fall. It further provides a simple, convenient and effective way to stow the mounting step when not needed.

In another form, the improved stirrup arrangement comprises a mounting step rigidly connected to, and supported by, a laterally offset brace which, in turn, is pivotally connected to a lower, laterally offset, area of the stirrup. The step and its support brace together form an "L" shape whereby, upon pivoting the brace, the mounting step is stowed, generally vertically and in greater part, above the level of the riding footrest, where it becomes a side wall of the stirrup foot entry. A resilient spring arrangement, associated with the pivotal connection, allows the sidewall step to rotate, and thereby move outwardly and downwardly under pressure. This movement creates a lateral opening, permitting a foot, otherwise trapped in the stirrup, to be released.

For mounting, the step and brace are rotated against the spring arrangement by hand to a position where the step latches into a horizontal, foot receiving attitude, well below the stirrup footrest. After mounting, foot pressure on the footrest releases the latch and the step rotates under spring pressure to its side wall, that is, riding position.

In both forms, appropriate stops are provided to limit rotation of the step between a functional, mounting aid position and a safe, foot withdrawal position. When the mounting aid device is pivoted from its normally stowed, upper, position downwardly, in both forms the step descends a sufficient distance below the stirrup support surface to substantially assist the rider in the mounting procedure. Once the rider is mounted, in one form of the improved stirrup, a quick forward jerk of the rider's foot will provide the impetus for the mounting portion to pivot up, roughly through about a quarter circle, and latch in foot protecting position. In the other form the mounting step device is hand cocked to its lower step position, where it locks for aiding the mounting procedure. After mounting the rider's foot on the footrest triggers a return of the mounting of the sidewall position where excess side pressure by the rider's foot causes pivotal wall movement sufficient to release an otherwise trapped foot.

BRIEF DESCRIPTION OF THE DRAWINGS

Reference is now made to the drawings, wherein like parts are designated by like numerals.

DETAILED DESCRIPTION

Figure 1:
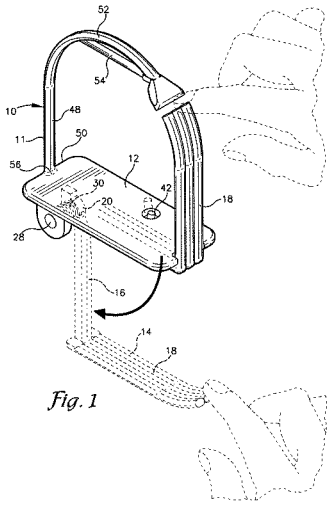
FIG. 1 is a perspective view of a first embodiment of the improved stirrup arrangement, showing the mounting step in stowed position and, by broken lines, also in functional position.

As required, detailed embodiments of the improvement are disclosed herein; however, it is to be understood that the disclosed embodiments are merely exemplary of the device, which may be embodied in various forms. Therefore, specific structural and functional details disclosed herein are not to be interpreted as limiting, but merely as a basis for the claims and as a representative basis for teaching one skilled in the art to variously employ the arrangement in virtually any appropriately detailed structure.

Referring to the drawings in more detail, in the embodiment of FIGS. 1-7, the numeral 10 designates one type of stirrup assembly, or arrangement, in accordance with the present improvement. The assembly 10 comprises a modified English-style stirrup, or sometimes called stirrup iron, although it should be understood that the claimed features are appropriate also with modified western-style stirrups shown in FIGS. 8 and 9.

The stirrup assembly 10 includes the basic functional parts to be considered a stirrup iron, such as a frame member 11 and footrest 12 but, in addition, has an auxiliary portion comprising a stirrup aid member, or mounting step device 14, comprised, in this example, of a laterally offset brace 16 supporting a mounting step 18. The upper end 20 of the mounting step device 14 is pivotally connected to the underside 22 of the bottom part, or footrest 12, of the stirrup iron. The footrest 12 has sufficient lateral extension for receiving a rider's foot 25 thereon, FIG. 2.

Figure 5:
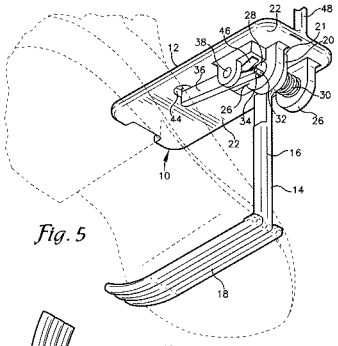
FIG. 5 is a partial, perspective view of the stirrup arrangement of FIG. 1 showing the mounting step in functional position and engaged with a mounting foot outlined by broken lines.
Figure 6:
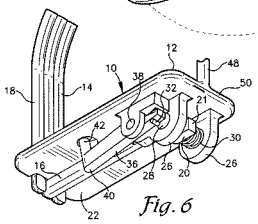
FIG. 6 is a partial perspective view of the stirrup arrangement of FIG. 1 showing the triggering of the mounting step release, resulting in the mounting step resting in the closed, sidewall stowed, position.
Figure 7:
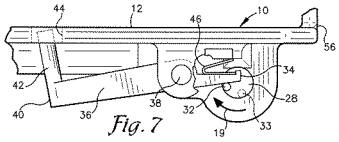
FIG. 7 is a partial elevational view of the stirrup of FIG. 1 with a portion broken away to show details of the mounting step latch release.

The pivotal connection between the mounting step device 14 and the footrest 12, in this example, is provided by depending, spaced apart bearing mounts 26, FIGS. 5 and 6, receiving a transverse shaft 28 fixed to the device upper end 20 and surrounded by a helical spring 30. The mounting step device upper end 20 is shaped to provide a surface 21, FIG. 6, which contacts the underside 22 of the footrest 12 when the mounting step device 14 is rotated to the mounting position shown in FIG. 5. The surface 21 thereby provides a stop, rigidly preventing the mounting step from rotating beyond the position shown in FIG. 3 for mounting function. Contact between the brace 16 and the underside 22 of the footrest 12 produces a stop which prevents rotation in the opposite direction, past that shown in FIG. 2.

An offset, axially projecting pin 32, FIG. 5, is shown mounted in the shaft 28 resting in contact against one end 34 of a trigger lever 36. This contact prevents the transverse shaft 28 from rotating under pressure from helical spring 30, thus maintaining the mounting step device in depending, functional position.

The trigger lever 36 is mounted for rocking on a transverse pin 38 and, at its other end 40, terminates in a generally vertically projecting post 42 extending through and above an opening 44 in the footrest 12. An appropriate spring 46, best seen in FIG. 7, applies resilient pressure against the end 34 of the trigger lever 36, whereby the post 42 is urged upwardly through the opening 44 when such movement is not resisted by frictional contact with the pin 32 under the torsional pressure from the helical spring 30. However, when a foot is placed on the footrest 12 the post 42 is urged, by the under surface of the foot, downwardly, releasing the pin 32 and thereby permitting the helical spring 30 to rotate the mounting step 18 into its sidewall, stowed position, FIG. 2. The pin 32 then rests beneath the lever trigger end 34, preventing the post 42 from rising until the mounting step is again needed, FIG. 6.

The stirrup iron, in this example, has a fixed sidewall 48 which locates on the horse side of the stirrup assembly during normal use. The sidewall 48 is fixed to one end 50 of the footrest 12 and curves at its upper portion 52 to produce a shape similar to the inverted letter "J." The upper portion 52 of the sidewall 48 includes a bridge 54 through which an adjustable leather support strap (not shown) may be engaged in a conventional manner.

Figure 2:
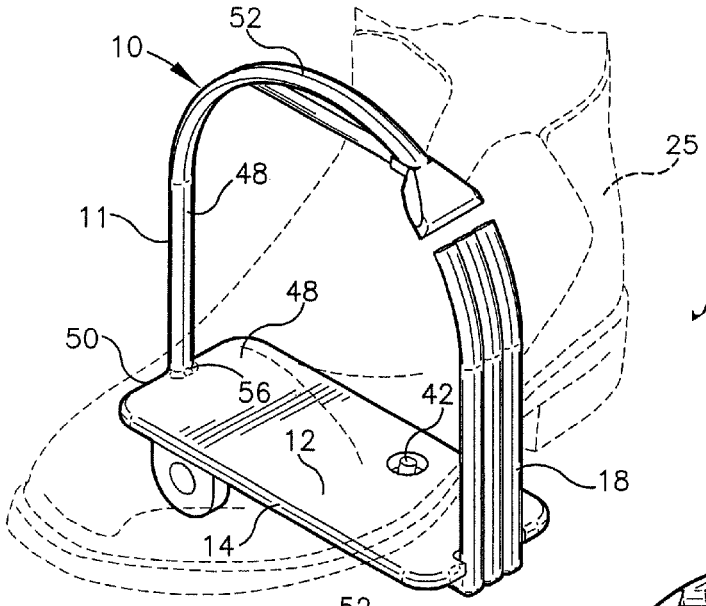
FIG. 2 is a perspective view of the stirrup arrangement of FIG. 1 showing, by broken lines, a rider's foot in riding position.

In the example shown in FIGS. 1-7 the footrest 12 is supported only by the connection 56 between the sidewall 48 and the footrest 12, however, the sidewall and connection can be modified in size and strength as needed for performance. The desired closure, or surrounding of the foot resting on the footrest, in this example, is provided by the mounting step 18 when in stowed position, as best illustrated in FIG. 2. It is to be understood that additional braces or sidewall members (not shown) could be used in conjunction with the stowed mounting step 18 to provide additional resistance against foot release under special circumstances, such as unusually hard riding. However, this would tend to defeat the safety feature offered by the improved arrangement by increasing the danger of foot locking in the stirrup in case of a fall.

Figure 3:
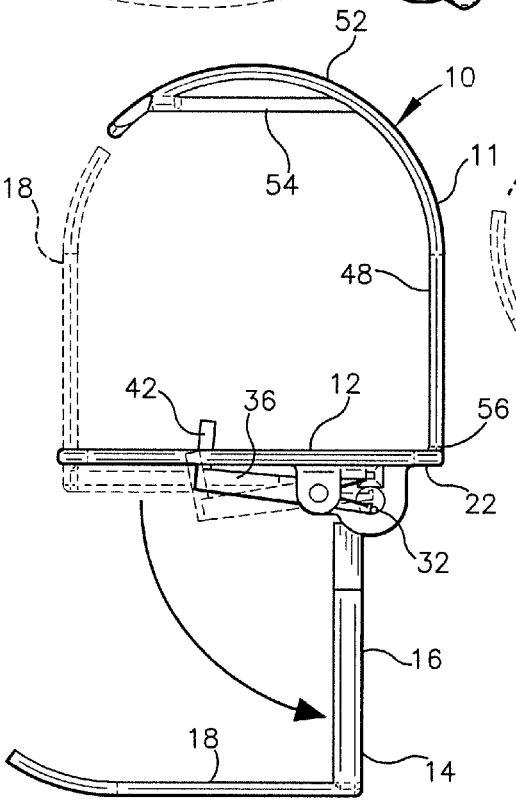
FIG. 3 is a front elevational view of the stirrup arrangement of FIG. 1 showing the mounting step in functional position and, by broken lines, in stowed position.
Figure 4:
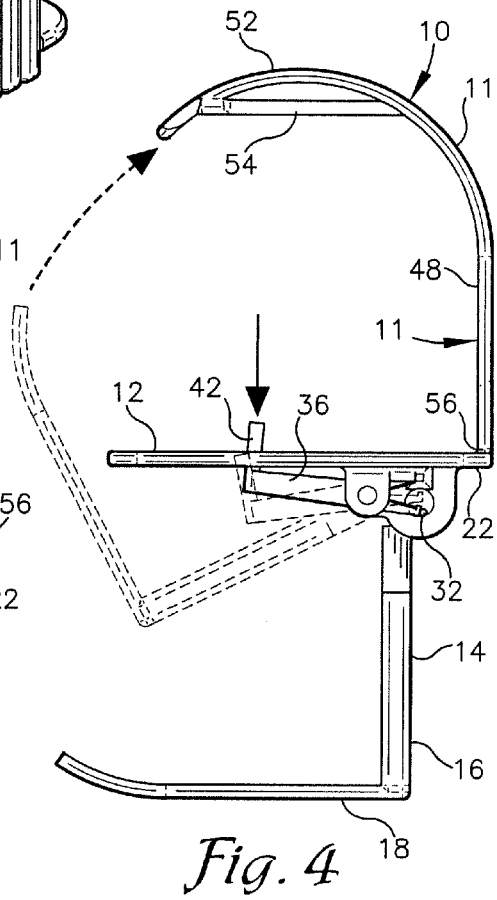
FIG. 4 is a front elevational view of the stirrup arrangement of FIG. 1 showing, by broken lines, an intermediate position of the mounting step pivoting toward the stowed position.

One functional operation series for the example shown in FIGS. 1-7 is as follows: FIG. 1 illustrates, in broken lines, a finger contacting the mounting step 18, shown in a stowed position from prior use of the stirrup iron. By being pulled downwardly, the mounting step 18 rotates about the shaft 28, winding the helical spring 30. This movement also rotates the pin 32 counterclockwise about the axis of the shaft 28, toward the position 33, as shown in broken lines, FIG. 7. This allows the spring 46 to raise the post 42 to the point where the trigger lever 36 urges the post 42 through the footrest 12 to a position terminating above the footrest surface, as shown in FIG. 3. This also allows the pin 32 to engage the end 34 of the lever 36, locking the mounting step 18 in a position substantially below the footrest 24 and at a level more conveniently reached by the person mounting the horse to more easily swing up and over the horse and into the saddle (not shown). The foot is then removed from the mounting step 18 and placed on the footrest, virtually automatically depressing the post 42 down to approximately the same level as the footrest surface. This causes trigger lever end 34 to move off of the pin 32 whereupon the helical spring 30 rotates the brace 16, and its attached mounting step 18 clockwise as shown in FIG. 4 and the arrow 19 of FIG. 7. The rotation stops when the mounting step reaches the stowed position shown in FIG. 2 for riding. The above results are obtained while the rotating mounting step moves only through about a quarter circle instead of the apparent need for a half circle or greater rotation.

Further, if the rider should fall, due to rough riding or other reason, the stowed mounting step 18 will rotate outwardly and downwardly, under the pressure of a foot, which may otherwise be trapped. This will produce a release, virtually eliminating the danger of a foot lock, and being dragged head down. In the event a rider prefers a greater resistance to rotation than supplied, this can often be adequately addressed through selecting a helical spring of greater resistance.

Figure 8:
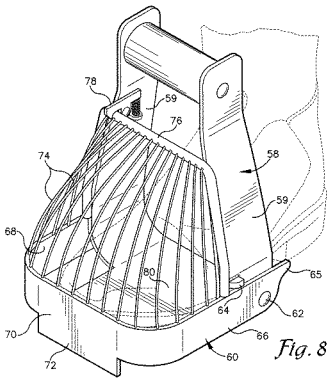
FIG. 8 is a perspective view of a second embodiment of the improved stirrup arrangement, showing the mounting step in latched, stowed position and, by broken lines, a rider's foot safely received in riding position.
Figure 9:
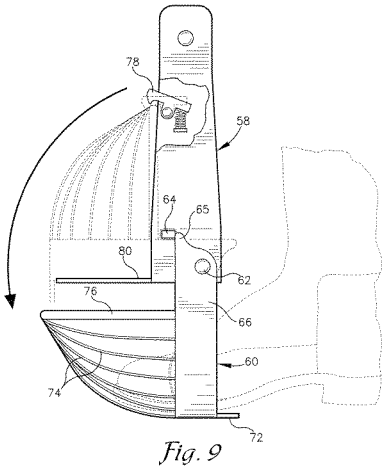
FIG. 9 is a side elevational view of the embodiment of FIG. 8 showing the mounting step unlatched into functional mounting position and receiving a foot, illustrated in broken lines.

Turning now to the second embodiment, illustrated in FIGS. 8 and 9, which is adapted for use with a western-style stirrup iron 58 having spaced apart side walls 59. A bottom portion or mounting step 60 is rotatably connected by side mounted pivots 62 for pivotal motion from a forwardly projecting position, shown in FIG. 8, to a generally vertical position shown in FIG. 9. The rotation from the horizontal to the vertical position is restricted, in this example, by a projecting stop 64 which is positioned to contact a mating projection 65 on mounting step sidewalls 66 and 68. The center area 70 of the bottom portion or mounting step 60 has an extension 72 providing additional support for contact between the foot, shown in broken lines, and the mounting step, FIG. 9.

Spaced-apart thin bars or wires 74 extend from the sidewalls and center of the mounting step 60 to an anchor rod 76, also connected to the bottom portion or mounting step 60, together forming a hollow, open ended cage for receiving the foot therein. Although thin bars or wires are shown in the present example, the hollow open ended foot receiver may be constructed of a variety of other materials, such as leather, screen or suitable plastic.

The mounting step 60 is normally maintained in position forwardly and frontally of the stirrup iron 58 by means of one or more appropriate latches 78 which, in this example, engage the anchor rod 76. In this position a receiving volume is created whereby a foot may enter the open end and ride comfortably without danger of the foot extending through the stirrup iron and being dangerously trapped in case of a fall.

When, however, it is desired to utilize the device as a mounting step, it is a simple matter to release the latch 78 whereupon the bottom portion or mounting step 60 moves through a surprisingly small approximate quarter circle, whereupon the projection 64 of the sidewall 66 contacts the stop 62 and the mounting step 60 is presented for use at a significantly lower level than the riding surface or footrest 80. In this location the mounting step 60, and its extension 72, are presented generally horizontally and substantially lower than the functional stirrup surface, thereby serving as a more convenient and safe target for the rider to utilize by foot insertion and swinging upwardly into the saddle.

Once in the saddle a simple forward kick against the mounting step by the foot will easily pivot the step into the prior upper latched position where the foot confining configuration is in effect for safe riding. In addition, the arrangement described provides a convenient and effective ability to stow the mounting step.

Many other changes and modifications can be made in the design of the present arrangement without departing from the spirit thereof. Therefore it is requested that the rights to the improvement be limited only by the scope of the appended claims.

The following is claimed and desired to be secured by Letters Patent:

1. A stirrup assembly comprising (a) a frame member and a footrest supported by said frame member, the footrest including an opening (b) a mounting step device pivotally mounted with respect to said frame member and adapted to pivot within a range between a first position which is at least, in part, elevated to a height equal to or greater than said footrest and a second, latched position which is substantially below the elevation of said footrest, said pivoting range being limited to an arc of approximately 90 degrees (c) a trigger member on said footrest, the trigger member having a release post extending through said opening and projecting above said footrest;

(d) a spring loaded device associated with said mounting step device and having a first spring member urging said mounting step device out of functional position and toward a stowed position;

(e) lock means preventing said mounting device from moving out of functioning position; and (f) means connecting said trigger to said lock means, the connecting means having a second spring member adapted to release said lock means upon applying foot pressure on said release post extending through said opening and projecting above said footrest.

2. The stirrup assembly of claim 1 wherein said assembly includes stop means limiting the extent of said arc between said positions.

3. The stirrup assembly of claim 1 wherein said assembly includes at least one rigid stop on said frame member, said stop being located in the path of, and engaging, said mounting step member, thereby limiting the extent of said arc.

4. The stirrup assembly of claim 1 wherein said mounting step device includes a brace, means pivotally mounting said brace in a laterally offset position on said footrest, and a mounting step fixed to said brace and extending at an angle therefrom.

5. The stirrup assembly of claim 1 wherein said mounting step device comprises a brace pivotally mounted on said footrest and a mounting step fixed to said brace forming an "L" shaped configuration therewith.

6. The stirrup assembly of claim 1 including a spring loaded driver adapted to rotate said mounting step device toward said first position, and a trigger device preventing said rotation toward said first position until a foot is placed on said footrest.

* * * * *